US006375570B1

(12) United States Patent
Poole

(10) Patent No.: US 6,375,570 B1
(45) Date of Patent: Apr. 23, 2002

(54) GAMING DEVICE DISPLAYING AN EXHIBITION FOR REPLACING VIDEO REELS

(75) Inventor: Richard W. Poole, Reno, NV (US)

(73) Assignee: IGT, Reno, NV (US)

( * ) Notice: Subject to any disclaimer, the term of this patent is extended or adjusted under 35 U.S.C. 154(b) by 0 days.

(21) Appl. No.: 09/606,733

(22) Filed: Jun. 29, 2000

(51) Int. Cl.[7] ..... A63F 9/24
(52) U.S. Cl. ..... 463/31; 463/20
(58) Field of Search ..... 463/16, 20, 31; 273/143 R

(56) References Cited

U.S. PATENT DOCUMENTS 5,342,047 A 8/1994 Heidel et al.
5,393,061 A * 2/1995 Manship
5,449,173 A * 9/1995 Thomas et al.
5,609,524 A * 3/1997 Inoue
5,766,074 A 6/1998 Cannon et al.
5,919,091 A * 7/1999 Bell et al.
5,951,347 A 9/1999 Dichinson
5,980,384 A * 11/1999 Barrie
5,984,781 A 11/1999 Sunaga
5,997,401 A * 12/1999 Crawford
6,033,307 A 3/2000 Vancura
6,056,642 A 5/2000 Bennett
6,059,289 A 5/2000 Vancura
6,071,192 A * 6/2000 Weiss
6,089,976 A 7/2000 Schneider et al.
6,089,977 A * 7/2000 Bennett
6,095,921 A * 8/2000 Walker et al.
6,110,041 A * 8/2000 Walker et al.
6,135,885 A * 10/2000 Lermusiaux
6,142,874 A * 11/2000 Kodachi et al.
6,159,095 A * 12/2000 Frohm et al.
6,159,097 A * 12/2000 Gura
6,159,098 A * 12/2000 Slomiany et al.

OTHER PUBLICATIONS

Description of Gaming Machine with Animating Symbols, date unknown.
Description of Animating Symbol Features in Gaming Machines, date unknown.
Description of Symbol Features in Australian UFO Gaming Machine published by Barcrest Ltd in 1995.

* cited by examiner

*Primary Examiner*—Michael O'Neill
(74) *Attorney, Agent, or Firm*—Bell, Boyd & Lloyd LLC

(57) ABSTRACT

The present invention relates to a game for a gaming device which involves using reels for more than one purpose. The gaming device uses reels to display and determine outcomes, such as awards and penalties. The game also uses the same reels to perform exhibitions for the player. As exhibitions, the reels can be animated, used to form a background screen for exhibitions or used for any combination thereof. This type of game increases player entertainment and excitement.

25 Claims, 6 Drawing Sheets

GAMING DEVICE DISPLAYING AN EXHIBITION FOR REPLACING VIDEO REELS

CROSS-REFERENCE TO RELATED APPLICATION

This application is related to the following commonly-owned co-pending patent applications: "Gaming Device With Traveling Reel symbols," Ser. No. 09/606,928; "Gaming Device With Moving Screen Simulation," Ser. No. 09/625,884; "Gaming Device with Signified Reel Symbols," Ser. No. 09/605,344; "Gaming Device Having Touch Activated Alternating or Changing Symbol," Ser. No. 09/602,331; "Gaming Device Providing Touch Activated Symbol Information," Ser. No. 09/680,349; "Gaming Device With Traveling Reel Symbols," Ser. No. 09/689,197; and "Gaming Device Having A Symbol Covering Feature," Ser. No. 09/684,275.

COPYRIGHT NOTICE

A portion of the disclosure of this patent document contains material which is subject to copyright protection. The copyright owner has no objection to the photocopy reproduction by anyone of the patent document or the patent disclosure in exactly the form it appears in the Patent and Trademark Office patent file or records, but otherwise reserves all copyright rights whatsoever.

DESCRIPTION

The present invention relates in general to a gaming device, and more particularly to a gaming device including the use of reels for multiple purposes, such as determining game outcomes and providing exhibitions.

BACKGROUND OF THE INVENTION

The games in many existing gaming machines, such as traditional slot machines, are based upon the concept of spinning reels. The player initiates the spin of the reels, and where the reels stop determines whether a player wins credits and, if so, how many credits the player wins. When a player wins credits or when the game terminates, these gaming machines typically perform certain activities. For example, they often display the amount of credits earned, flash lights, make sounds or perform other activities in order to bring attention to the event and to entertain the player. These existing gaming machines do not use the reels to provide exhibitions to bring attention to game events.

To increase player enjoyment and excitement, it is desirable to provide players with new games for gaming devices which use reels to determine game outcomes and also to provide exhibitions in order to bring attention to events and to entertain players.

SUMMARY OF THE INVENTION

The present invention overcomes the above shortcomings by providing a gaming device and method which has a game wherein a plurality of reels, preferably video reels are used for two or more purposes. The reels are adjacent to one another, and each reel displays a plurality of indicia or symbols. Functionally, each reel spins, comes to a stop and displays symbols. The term display, as used herein, means to show, perform or otherwise represent a person, place or thing visually and/or audibly.

The symbols which are displayed on each reel in relation to each other form a combination of symbols. Preferably, certain combinations of symbols share a theme. For example, if all of the symbols are different types of airplanes, the theme could be airplanes or if all of the symbols are different types of fruit, the theme could be fruit.

Furthermore, when a player reaches certain events or combinations of symbols (hereafter referred to as "triggering combinations"), the game will provide certain outcomes, such as providing the player with credits or bonus credits, automatically spinning the reels, providing the player with the opportunity to gain credits or bonus credits, deducting credits or bonus credits from the player, terminating the game or otherwise generating a game event or determining the outcome of the game.

Preferably, before any of these outcomes occur, the computer of the gaming device uses the reels to perform certain exhibitions which are preferably related to the theme of the triggering combination. The term, exhibition as used in this specification means: (a) reels which are animated; and/or (b) an audio, visual or audiovisual representation of a person, place or thing in motion or at rest, including video images, graphics, activities, animations, virtual representations, simulations or movement. Animated reels are reels which have movement or simulated movement or reels which vibrate or shake, rotate, flip over, move upwards, downwards, or from side to side, bend, transform into a different shape or size, separate into different parts, expand or contract, change colors, shades or patterns, illuminate, make sounds or otherwise have dynamic characteristics. The computer can provide the exhibitions in one screen shot or in a succession of screen shots.

In operation, a player inserts money, coins, tokens or otherwise makes a payment to the gaming device. The computer then provides the player with credits which correspond to the amount of payment made. The player pushes a play button or other activator which causes the reels to spin. As long as the player has credits remaining, the game enables the player to repeatedly spin the reels until the player reaches a triggering combination.

When the player reaches a triggering combination, the computer uses the reels to perform an exhibition or replaces certain of the reels to perform an exhibition. If, for example, a triggering combination includes race cars, the computer could use the area of one or more reels to audiovisually exhibit a race car in motion. If, on the other hand, a triggering combination includes dynamite, one or more animated reels could explode into numerous parts as an exhibition. The computer could use this type of exhibition when a player runs out of credits.

It should be appreciated that the foregoing examples are merely illustrations and that the computer can use the reels to perform any exhibition of any kind for any purpose. It should also be appreciated that the gaming device can be adapted to use the reels to perform exhibitions before, during or after a triggering combination occurs or when the game begins or terminates.

Preferably, when the exhibitions are complete, the game provides the player with an outcome, such as providing the player with credits or bonus credits, automatically spinning the reels, providing the player with the opportunity to gain credits or bonus credits, deducting credits or bonus credits from the player, terminating the game or otherwise generating a game event or determining the outcome of the game. Which particular outcome occurs is predetermined and preferably programmed into the gaming device computer.

In one embodiment, the gaming device includes five video reels. Each reel, when not spinning, displays three symbols. As such, the reels display three rows of symbols. The game enables the player to obtain triggering combinations on several, and preferably nine lines. These lines extend from reel to reel, and they connect one or more symbols. The manner in which any particular line connects symbols is predetermined, preferably in the computer of the gaming device.

One of preferably several triggering combinations is a plurality of identical images of characters, and in one embodiment these images are characters such as elephants. When this triggering combination occurs, the gaming device provides the player with bonus spins as an outcome. Prior to providing this outcome, the computer combines the middle three reels into a display area and displays an exhibition such as an animated elephant for a limited amount of time.

After the exhibition is completed, the exhibition disappears, the three reels return to their original state—displaying the triggering combination. Then, momentarily, the reels move back and forth laterally to give the effect that the reels are vibrating or shaking. This shaking effect gradually increases in magnitude and is designed to simulate the vibration caused by the roaring, walking or running of an elephant.

After the reels shake, the game automatically spins the outer two reels, preferably in opposite directions. Preferably, the game automatically conducts this bonus spin three times. At the beginning of each bonus spin, the middle three reels exhibit the animated elephant momentarily, the middle three reels shake and then the outer two reels spin. At the end of each bonus spin, the player can gain bonus credits, preferably depending upon what symbols the reels exhibit when they stop spinning. After the bonus spinning is complete, the game provides the player with all bonus credits gained.

The game then enables the player to continue making spins, as long as the player has credits remaining. This process continues until the player runs out of credits or cashes out. After cashing out, the game awards the player with a payout which corresponds to the remaining credits.

In an alternative embodiment as an outcome, the gaming device provides the player with predetermined credits. Prior to providing the outcome, the computer combines the middle three reels into one screen shot and exhibits an animated elephant for a limited amount of time. Next, the game enables the player to make additional spins. This process continues until the player runs out of credits or cashes out.

Both embodiments preferably include one or more textual messages for the player. Preferably, the game displays these messages when a triggering combination occurs and when the game is providing the player with an outcome. Also, if the game enables the player to gain bonus credits, the game preferably displays a message at the end of the bonus spins.

In addition, both embodiments preferably include a line message corresponding to each line. The line message displays the numeric credits which the player decided to bet for the lines. Also, if the gaming device provides the player with bonus spins, the game preferably includes a bonus spin window. The bonus spin window begins by displaying a numeral which decreases by one each time a bonus spin is completed.

Preferably, the gaming device also includes a plurality of windows for providing information to the player and for entertaining the player. Also, the gaming device preferably includes a plurality of buttons for operating the game.

It is therefore an object of the present invention to provide a gaming device with reels which are used to determine game outcomes and also to provide exhibitions to the player.

Other objects, features and advantages of the invention will be apparent from the following detailed disclosure, taken in conjunction with the accompanying sheets of drawings, wherein like numerals refer to like parts, elements, components, steps and processes.

DETAILED DESCRIPTION OF THE INVENTION

Gaming Device and Electronics

Figure 1:
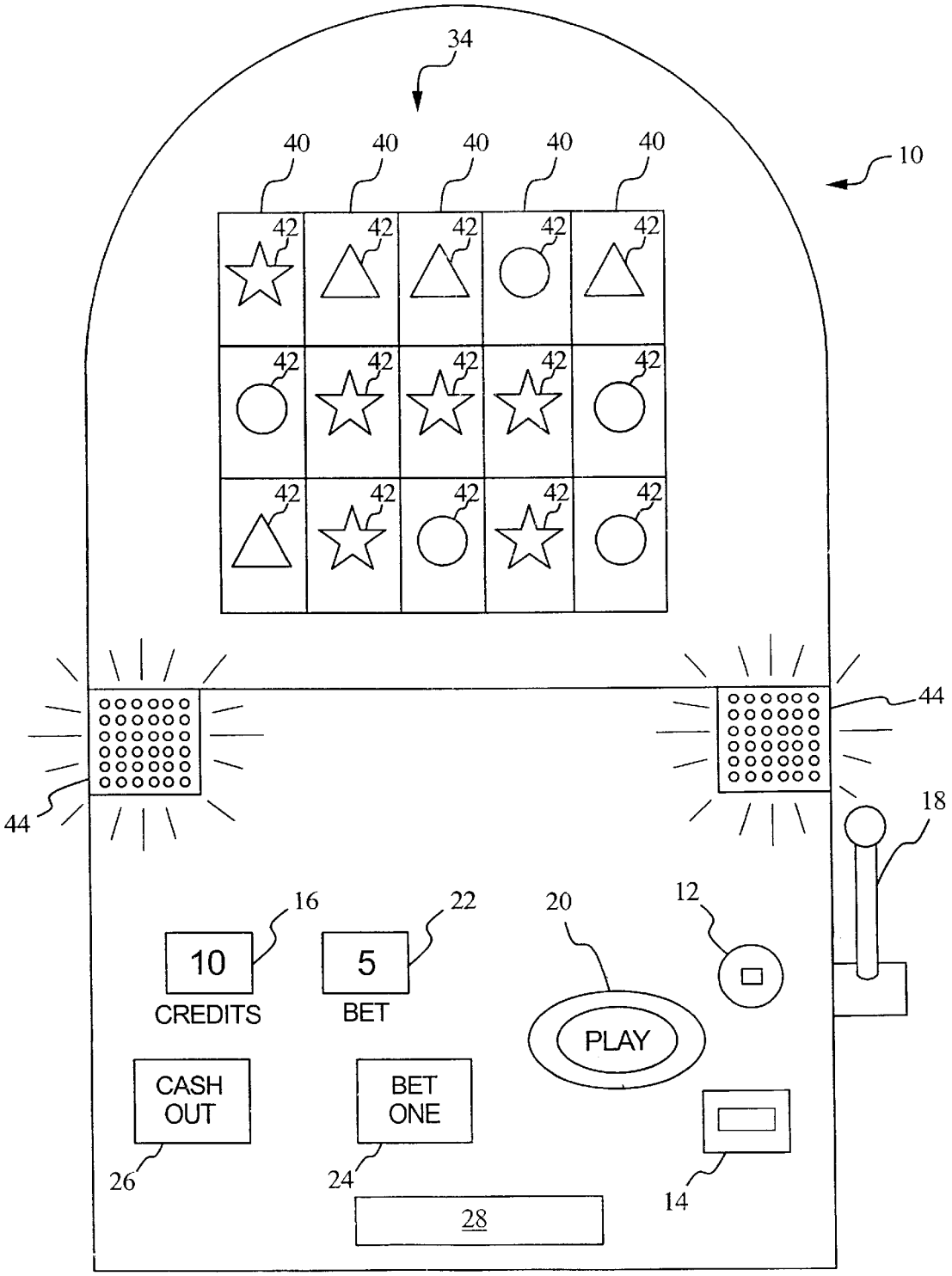
FIG. 1 is a front plan view of one embodiment of the gaming device of the present invention.

Referring now to the drawings, FIG. 1 generally illustrates a gaming device 10 of one embodiment of the present invention, which is preferably a slot machine having the controls, displays and features of a conventional slot machine. Gaming device 10 is constructed so that a player can operate gaming device 10 while standing or sitting. However, it should be appreciated that gaming device 10 can be constructed as a pub-style table-top game (not shown) which a player can operate preferably while sitting. Gaming device 10 can also be implemented as a program code stored in a detachable cartridge for operating a hand-held video game device. Also, gaming device 10 can be implemented as a program code stored on a disk or other memory device which a player can use in a desktop or laptop personal computer or other computerized platform.

Gaming device 10 can incorporate any game such as slot, poker or keno in addition to any triggering combination. The indicia used on and in gaming device 10 may be in mechanical, electrical or video form.

As illustrated in FIG. 1, gaming device 10 includes a coin slot 12 and bill acceptor 14 where the player inserts money, coins or tokens. The player can place coins in the coin slot 12 or paper money in the bill acceptor 14. Other devices could be used for accepting payment such as readers or validators for credit cards or debit cards. When a player inserts money in gaming device 10, a number of credits corresponding to the amount deposited is shown in a credit display 16. After depositing the appropriate amount of money, a player can begin the game by pulling arm 18 or pushing play button 20. Play button 20 can be any play activator used by the player which starts any game or sequence of events in the gaming device.

As shown in FIG. 1, gaming device 10 also includes a bet display 22 and a bet one button 24. The player places a bet by pushing the bet one button 24. The player can increase the bet by one credit each time the player pushes the bet one button 24. When the player pushes the bet one button 24, the number of credits shown in the credit display 16 decreases by one, and the number of credits shown in the bet display 22 increases by one.

At any time during the game, a player may "cash out" and thereby receive a number of coins corresponding to the number of remaining credits by pushing a cash out button 26. When the player "cashes out," the player receives the coins in a coin payout tray 28. The gaming device 10 may employ other payout mechanisms such as credit slips redeemable by a cashier or electronically recordable cards which keep track of the player's credits.

Figure 2:
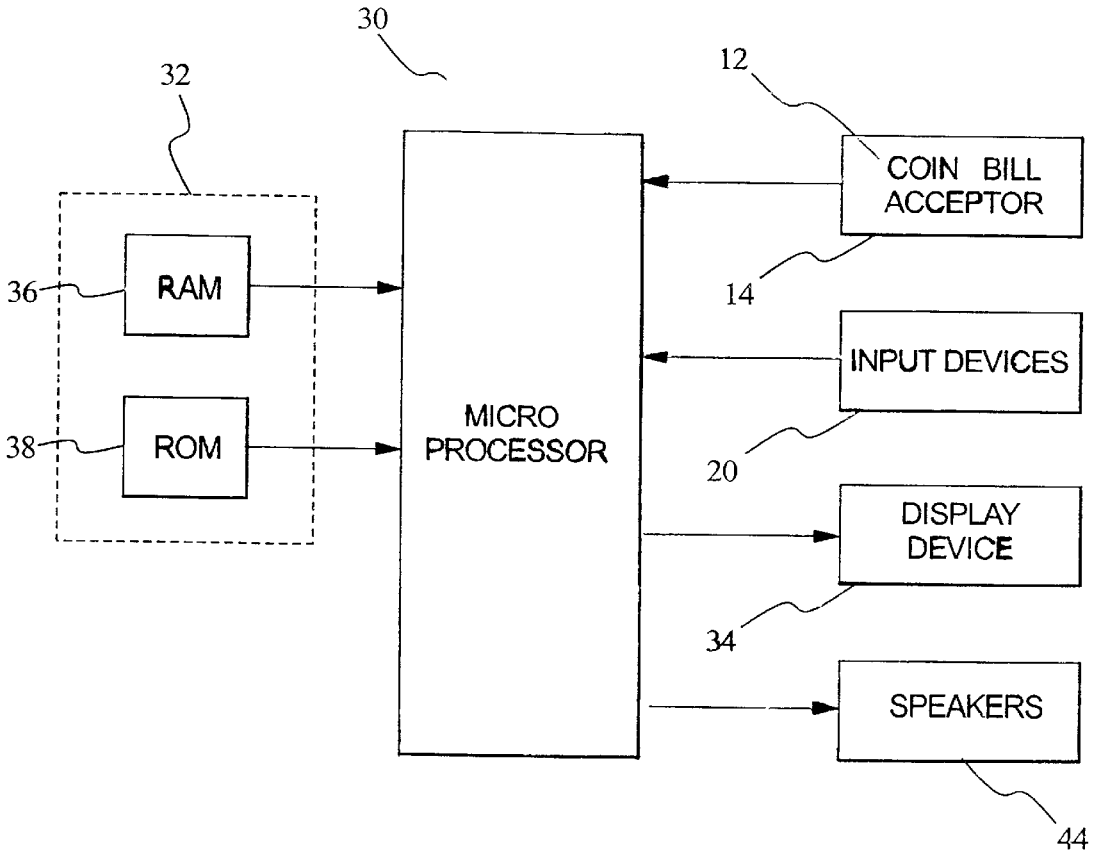
FIG. 2 is a schematic block diagram of the electronic configuration of one embodiment of the gaming device of the present invention.

With respect to electronics, gaming device 10 preferably includes the electronic configuration generally illustrated in FIG. 2, including a processor 30, a memory device 32 for storing program code or other data, a video monitor or other display device 34 (i.e., a liquid crystal display) and at least one input device such as play buttons 20. The processor 30 is preferably a microprocessor or microcontroller-based platform which is capable of displaying and exhibiting images, symbols and other indicia such as images of people, characters, places, things and faces of cards. The memory device 32 can include random access memory (RAM) 36 for storing event data or other data generated or used during a particular game. The memory device 32 can also include read only memory (ROM) 38 for storing program code which controls the gaming device 10 so that it plays a particular game in accordance with applicable game rules and pay tables.

It should be appreciated that although a processor 30 and memory device 32 are preferable implementations of the present invention, the present invention can also be implemented using one or more application-specific integrated circuits (ASIC's) or other hard-wired devices, or using mechanical devices (collectively referred to herein as a "processor"). Furthermore, although the processor 30 and memory device 32 preferably reside on each gaming device 10 unit, it is possible to provide some or all of their functions at a central location such as a network server for communication to a playing station such as over a local area network (LAN), wide area network (WAN), Internet connection, microwave link, and the like. The processor 30 and memory device 32 are generally referred to herein as the "computer."

Game Scheme

With reference to FIGS. 1 and 2, display device 34 contains a plurality of reels 40, preferably five reels in mechanical, video or virtual form. Preferably, reels 40 are in video or virtual form. Each reel 40 displays a plurality of symbols 42 such as bells, hearts, fruits, characters, numbers, letters, bars or other images which preferably correspond to a theme associated with the gaming device 1 0. If the reels 40 are in video or virtual form, display device 34 is preferably a video monitor. Furthermore, gaming device 10 preferably includes speakers 44 for making sounds or playing music consistent with the theme of the game scheme.

With continued reference to FIGS. 1 and 2, to operate the gaming device 10, the player must insert the appropriate amount of money or tokens at coin slot 12 or bill acceptor 14 and then pull the arm 18 or push the play button 20. The reels 40 will then begin to spin. Eventually, the reels 40 will come to a stop. As long as the player has credits remaining, the player can spin the reels 40 again.

Reels 40 include a plurality of indicia or symbols 42, visible to the player. The symbols 42 which are displayed are preferably a relatively small number of symbols 42, when compared to the total number of symbols 42 on a reel 40. When the reels 40 are at rest, they present various combinations of symbols 42. As illustrated in FIG. 1, a triggering combination could be three stars appearing in the same location on three adjacent reels 40.

When the player reaches a triggering combination, the gaming device computer provides the player with an outcome, such as providing the player with credits or bonus credits, automatically spinning the reels, providing the player with the opportunity to gain credits or bonus credits, deducting credits or bonus credits from the player, terminating the game or otherwise generating a game event or determining the outcome of the game. The outcomes of a game are predetermined and preferably programmed into the computer.

The computer also provides the player with one or more exhibitions using reels 40, preferably immediately prior to providing any of these outcomes. In exhibitions, the area of one or more reels 40 can be used as background for any type of exhibition. Preferably, two or more reels 40 are combined to provide a larger display or exhibition area appropriate for such an exhibition.

Furthermore, reels 40 themselves can be animated in the exhibitions. Any particular gaming device may use reels 40 as backgrounds for exhibitions and/or directly involve animated reels 40 in the exhibitions, depending upon the scheme of the game. It should be appreciated that the gaming device can provide an exhibition before, during or after the gaming device 10 provides the player with an outcome, such as when the game begins or when the game terminates.

Figure 3:
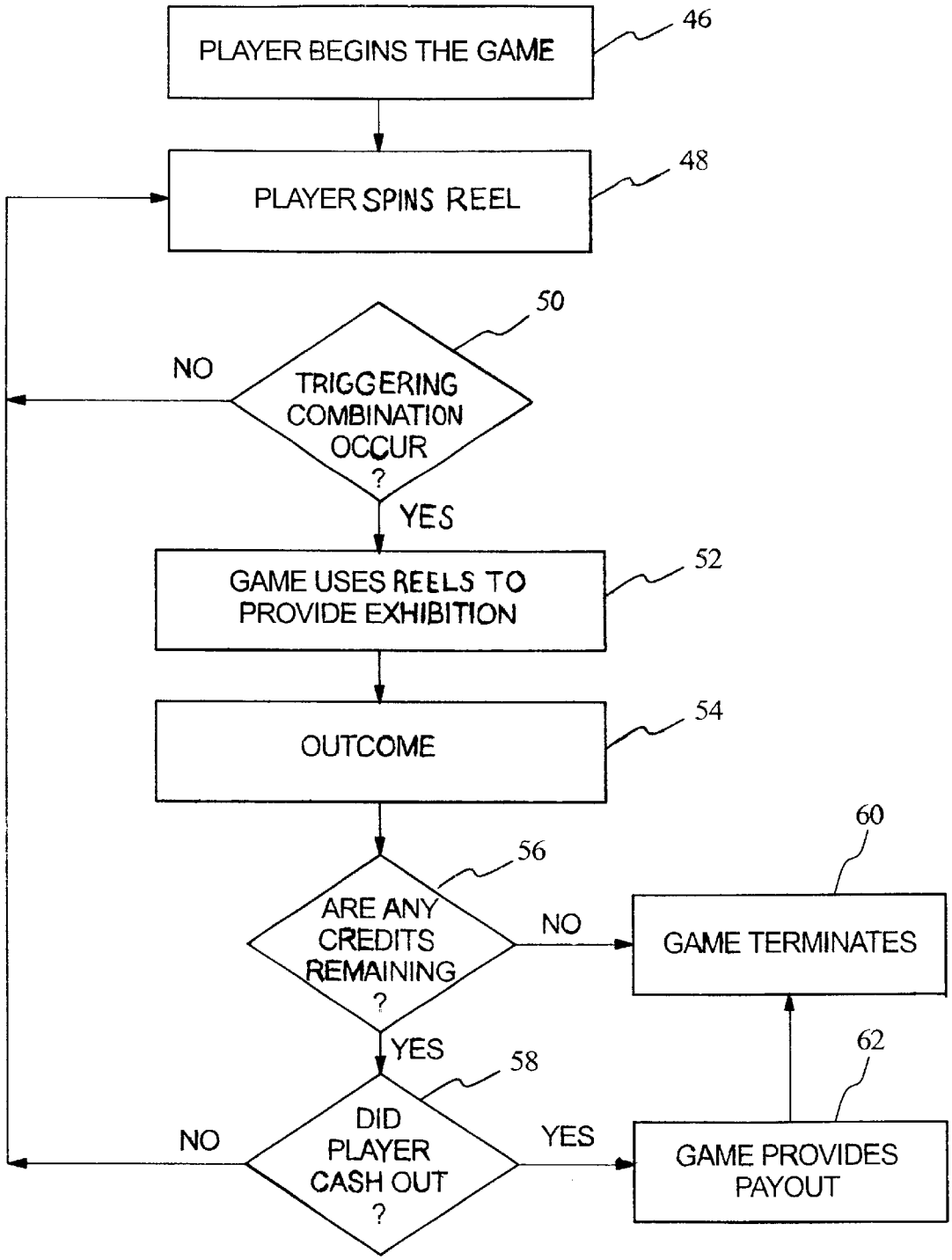
FIG. 3 is a flow diagram of one embodiment of the present invention.

As indicated by block 46 in FIG. 3, in operation a player begins the game of gaming device 10 by making a payment to the gaming device 10 and selecting the player's bet options. Then by pushing the play button 10, the player causes reels 40 to spin, as indicated by block 48. As indicated by diamond 50 in FIG. 3, if a triggering combination does not occur, the game enables the player to spin again by pushing play button 20 again. This process continues until the player reaches a triggering combination.

As indicated by diamond 50 and block 52, once the player reaches a triggering combination the gaming device of the present invention uses reels 40 to provide the player with one or more exhibitions. After the exhibitions have completed, the game then provides the player with an outcome, as indicated by block 54 in FIG. 3. An outcome can be the computer providing the player with credits or bonus credits, automatically spinning the reels, providing the player with the opportunity to gain credits or bonus credits, deducting credits or bonus credits from the player, terminating the game or otherwise generating a game event or determining the outcome of the game. The computer determines which particular outcome will occur, preferably through a predetermined program.

As indicated by diamonds 56 and 58, after the game provides the player with an outcome, if the player has remaining credits and if the player does not cash out, the game enables the player to make additional spins. However, if the player has no remaining credits, the game terminates as indicated by diamond 56 and block 60. If the player ever cashes out, the game provides the player with a payout corresponding to the remaining credits, and then the game terminates, as indicated by diamond 58, block 62 and block 60.

Preferably, the triggering combination includes symbols which share similarities or characteristics which define a common theme. For example, various animals as symbols may relate to an animal theme, various types of fruit may relate to a fruit theme and various types of automobiles may relate to an automobile theme. It is preferable that the triggering combination theme coincides with the exhibition theme. For example, if a triggering combination theme is automobiles, preferably the exhibition theme would be automobiles or at least be related to automobiles.

The game scheme of the present invention enables reels to be used for more than one purpose. The first purpose is the traditional role of slot machine reels, which is to display a combination of symbols on the gaming device which determines whether or not a player has gained credits, lost credits, been given the opportunity to gain additional credits, or been eliminated from the game. The second purpose of the reels is to perform exhibitions for the player to emphasize events in the game and also to entertain the player. The exhibitions use the reels as background screens for audio, visual, or audiovisual representations or animations. Furthermore, the gaming device can animate the reels as an exhibition or replace certain reels with the exhibition. Using one set of reels for these various purposes highlights gaming events and generally adds excitement and entertainment to the game.

Figure 4:
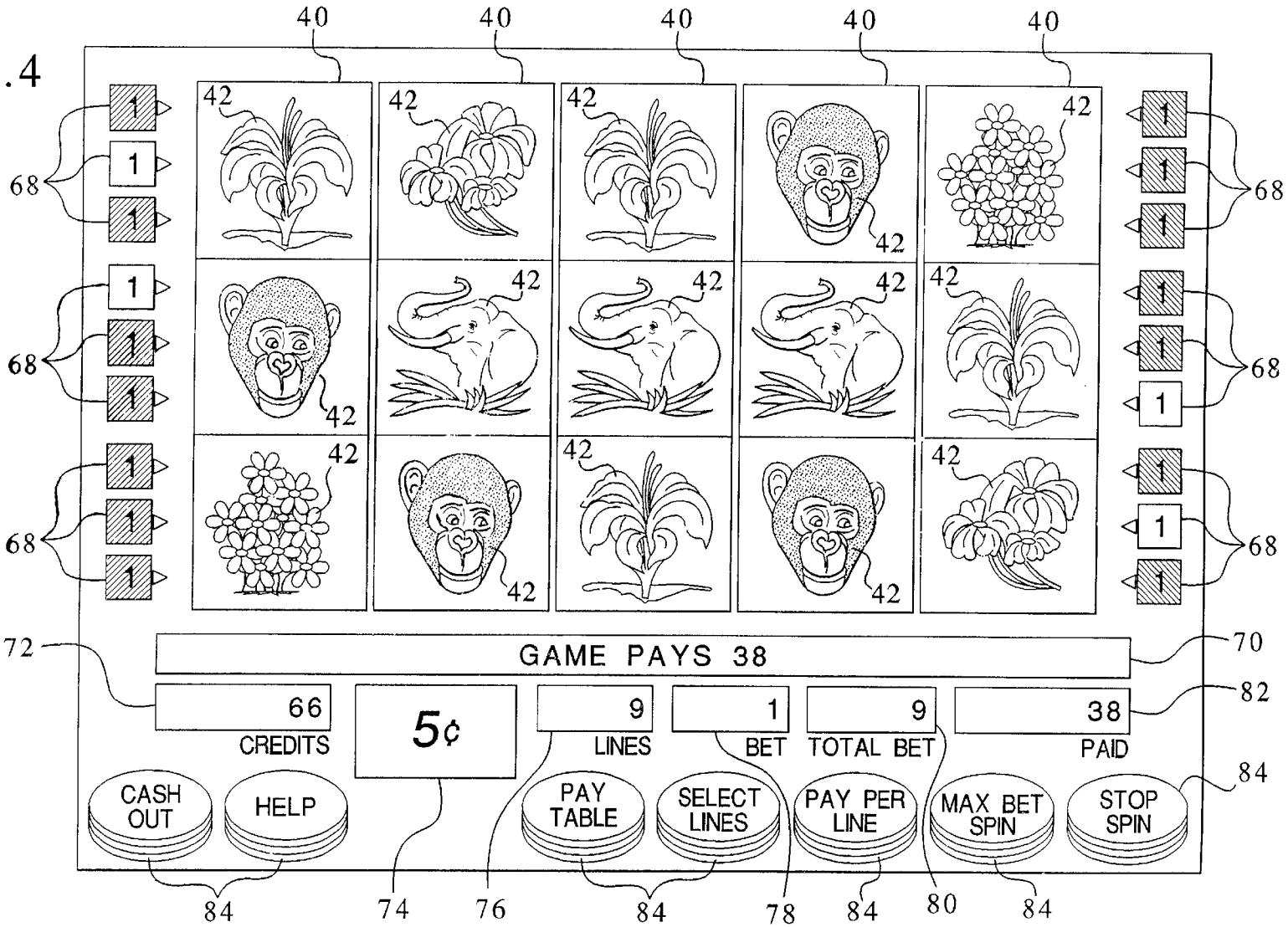
FIG. 4 is a top plan view of a triggering combination in one embodiment of the present invention.

In one embodiment of the present invention, gaming device 10 preferably includes five reels 40 shown in FIG. 4. When not in motion, each reel displays three symbols 42. The game enables the player to obtain triggering combinations along one or more lines, preferably nine lines. These lines connect one or more symbols 42 in predetermined patterns.

Figure 5:
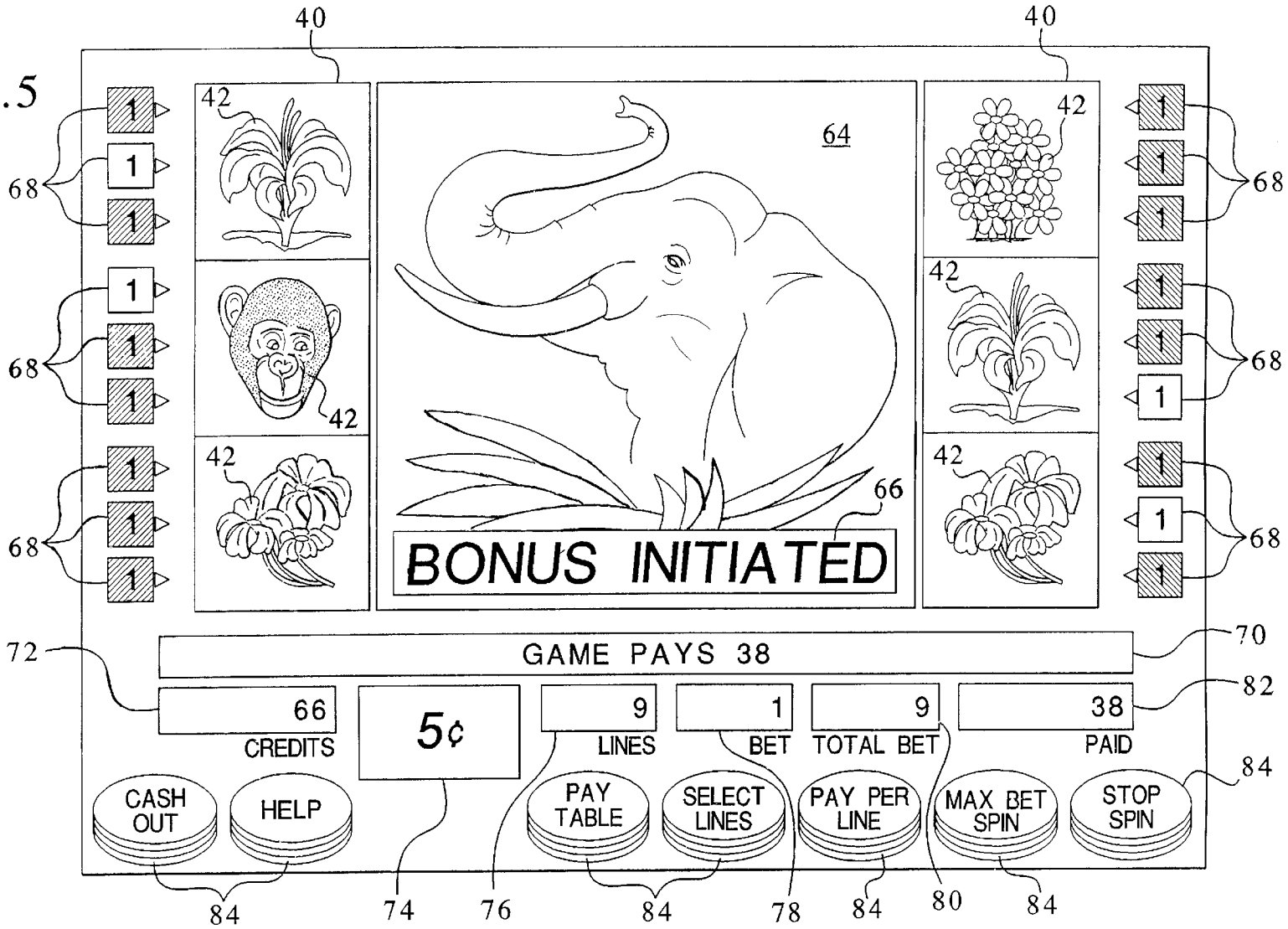
FIG. 5 is a top plan view of a reel exhibition of one embodiment of the present invention.
Figure 6:
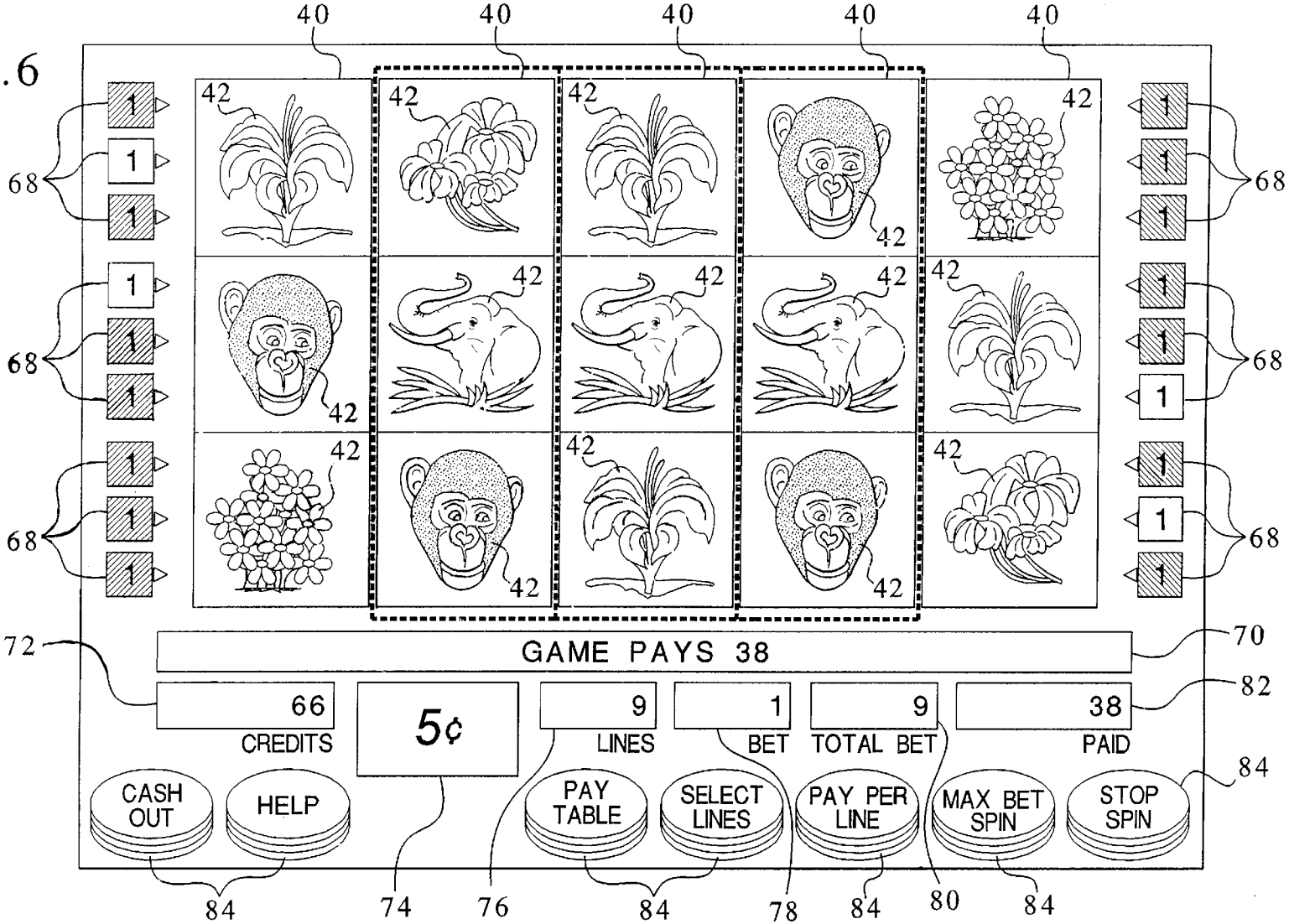
FIG. 6 is a top plan view of another reel exhibition of one embodiment of the present invention.

The symbols 42, shown in FIGS. 4 through 6, generally relate to animals and plants and share a jungle or zoo theme. The symbols 42 used in at least one triggering combination are identical images of elephants. Once the game begins, the player spins reels 40. If the player does not reach a triggering combination, the game enables the player to spin reels 40 again. As illustrated in FIG. 4, the triggering combination could be three consecutive elephants displayed at the same position on three reels 40. Once the triggering combination occurs as shown in FIG. 5, the game combines the middle three reels 40, into a single background screen 64, to exhibit an animated elephant. The animated elephant exhibits certain behavior designed to simulate the behavior of an actual elephant. The gaming device exhibits the animated elephant for a limited amount of time. After this time period is over, the gaming device replaces the animated elephant with the middle three reels 40 which originally made up the triggering combination, as shown in FIG. 6. The present invention is also preferably adapted to display an exhibition which includes simulating an element associated with a theme of the game. For instance, the game can simulate the ground around the elephant shaking.

Preferably immediately, these middle three reels 40 vibrate, shake or otherwise move laterally. These three reels are outlined in dotted lines to indicate shaking, as shown in FIG. 6. This movement gradually increases in magnitude and is designed to simulate the vibration caused in the environment by a roaring, walking or running elephant. After these middle three reels 40 have stopped their lateral movement, the first and last reels 40 begin to spin, preferably in opposite directions. After these two reels 40 come to a stop, the game awards the player with a bonus, preferably depending upon the particular symbol combination reached.

Preferably the gaming device automatically provides the player with three of these bonus spins, however any number of bonus spins can be provided to the player. Once all of the bonus spins are completed, if the player has remaining credits, the game enables the player to make additional spins. This process continues until the player runs out of credits or until the player cashes out, and in either case the game terminates.

In an alternative embodiment, when the player reaches a predetermined triggering combination, the game momentarily exhibits the animated elephant on the background screen 64, and the game then provides the player with credits. After providing the player with these credits, the game enables the player to spin reels 40 again. This process continues until the player cashes out or has no remaining credits.

This embodiment also preferably includes one or more messages 66, preferably in textual form. A message 66 is shown in FIG. 5 as "BONUS INITIATED." Other messages 66 can be included in the game and displayed before, during or after an exhibition. Preferably, if an outcome is an opportunity to gain bonus credits, the gaming device displays the message 66, "BONUS INITIATED" when the game exhibits the animated elephant. When the animated elephant first disappears, the gaming device preferably displays the message, "EVERY RE-SPIN IS A GUARANTEED WIN" (not shown), and when the bonus spins are completed, the gaming device preferably displays the message, "BONUS COMPLETED" (not shown). The game of the present invention can include alternative and additional messages 66. In addition, the gaming device includes a line message 68 shown in FIGS. 4 through 6. Line message 68 indicates, preferably in numeric form, the number of credits the player decided to bet for each line.

Furthermore, the game scheme of the present invention includes a plurality of windows for providing information to the player. Preferably, the gaming device includes: (a) a bonus spin window (now shown) which displays the number of remaining bonus spins; (b) a credit window 70 which displays the number of credits which the gaming device provides to a player after each spin; (c) a credit balance window 72 which displays the player's current credit balance; (d) a coin window 74 which displays the coin increments in which the player purchases credits or in which the gaming device makes payouts; (e) a line selection window 76 which displays the number of lines upon which the player is betting; (f) a bet window 78 which displays the number of credits the player is betting per line; (g) a total bet window 80 which displays the total credits which the player is betting; and (h) a pay window 82 which displays the total of credits which the gaming device has paid to the player on the previous game.

Preferably, the gaming device of the present invention also includes a plurality of buttons 84 which the player uses to select game options and play the game, including a cash out button, help button, pay table button, select lines button, bet per line button, max bet button and stop spin button.

As shown in FIGS. 4 through 6, the scenery for the preferred embodiments is a jungle, forest or other natural setting. In addition, the preferred embodiments can include audio features (i.e., songs, voices, and other sound effects) which are consistent with the jungle and elephant theme of this preferred embodiment.

The gaming device of the present invention involves the use of reels for multiple purposes. Reels are used for the traditional purpose of displaying symbols and determining awards for the player. Furthermore, the same reels are used to highlight game themes and entertain the player through interesting exhibitions and animations.

While the present invention has been described in connection with what is presently considered to be the most practical and preferred embodiments, it is to be understood that the invention is not limited to the disclosed embodiments, but on the contrary is intended to cover various modifications and equivalent arrangements included within the spirit and scope of the claims. It is thus to be understood that modifications and variations in the present invention may be made without departing from the novel aspects of this invention as defined in the claims, and that this application is to be limited only by the scope of the claims.

The invention is hereby claimed as follows:

1. A gaming device comprising:

a display device;

a processor which communicates with said display device;

a plurality of video reels displayed by said display device and controlled by said processor;

a plurality of symbols on said video reels;

a plurality of game outcomes; and an exhibition displayed by said display device and controlled by said processor which replaces at least one of said video reels adjacent to at least one other of said video reels when one of said symbols or a combination of said symbols occurs on said video reels, wherein said exhibition informs a player of the gaming device that the player has reached one of said plurality of game outcomes.

2. The gaming device of claim 1, wherein the game outcome reached by the player is an opportunity to play a bonus game.

3. The gaming device of claim 1, wherein the game outcome reached by the player is an award of bonus credits.

4. The gaming device of claim 1, wherein the game outcome reached by the player includes at least one spin of at least one of the video reels not replaced by the exhibition.

5. The gaming device of claim 1, wherein the game outcome reached by the player includes at least one spin of the video reels not replaced by the exhibition.

6. The gaming device of claim 1, wherein the game outcome reached by the player includes a plurality of spins of at least one of the video reels not replaced by the exhibition.

7. The gaming device of claim 1, wherein the game outcome reached by the player includes a plurality of spins of the video reels not replaced by the exhibition.

8. The gaming device of claim 1, wherein the game outcome reached by the player includes at least one spin of at least one of the video reels replaced by the exhibition.

9. The gaming device of claim 1, wherein the game outcome reached by the player includes at least one spin of at least one of the video reels replaced by the exhibition and at least one spin of at least one of the video reels not replaced by the exhibition.

10. The gaming device of claim 1, wherein the exhibition replaces at least one of said video reels between two of said other video reels.

11. The gaming device of claim 1, wherein the exhibition replaces a plurality of said video reels between two of said other video reels.

12. The gaming device of claim 1, which includes five video reels and the exhibition replaces at least two of said video reels.

13. The gaming device of claim 1, wherein the exhibition includes a textual message which informs the player of the game outcome.

14. A gaming device comprising:

a display device;

a processor which communicates with said display device;

a plurality of video reels displayed by said display device and controlled by said processor;

a plurality of symbols on said video reels;

at least one bonus spin of at least one said video reels; and an exhibition controlled by said processor and displayed by said display device when one of said symbols or a combination of said symbols occurs on said video reels, said exhibition replacing at least one of said video reels which is adjacent to at least one of said video reels which is not replaced by said exhibition and which spins during the bonus spin, wherein said exhibition informs a player of the gaming device that the player has reached said bonus spin.

15. A gaming device comprising:

a display device;

a processor which communicates with said display device;

a plurality of video reels displayed by said display device and controlled by said processor;

a plurality of symbols on said video reels; and an exhibition controlled by said processor and displayed by said display device which replaces at least one of said video reels adjacent to at least one other of said video reels when one of said symbols or a combination of said symbols occurs on said video reels, said exhibition informing a player that the player has obtained a bonus spin opportunity including at least one spin of at least one of said video reels.

16. The gaming device of claim 15, wherein the exhibition informs the player of which of the video reels will spin in said bonus spin opportunity.

17. The gaming device of claim 15, wherein the exhibition informs the player of a number of spins of said video reels which will occur in said bonus spin opportunity.

18. A gaming device comprising:

a display device;

a processor which communicates with said display device;

a plurality of video reels displayed by said display device and controlled by said processor;

a plurality of symbols on said video reels;

a plurality of game outcomes including a plurality of bonus spin outcomes; and an exhibition controlled by said processor and displayed by said display device upon a triggering event on said video reels, said exhibition replacing at least one of said video reels adjacent to one of the video reels not replaced by said exhibition, wherein said exhibition informs a player of the gaming device that the player has reached one of said plurality of bonus spin outcomes.

19. The gaming device of claim 18, wherein one of the plurality of bonus spin outcomes includes the video reels displaying said triggering event.

20. The gaming device of claim 18, wherein one of the plurality of bonus spin outcomes includes the video reels moving to give the effect that the reels are shaking.

21. The gaming device of claim 20, wherein one of the plurality of bonus spin outcomes includes the video reels gradually increasing said shaking effect.

22. The gaming device of claim 18, wherein one of the plurality of bonus spin outcomes includes at least two of said video reels spinning in opposite directions.

23. A method of providing a bonus opportunity to a player in a gaming device, said method comprising the steps of:

(a) displaying a plurality of video reels and a plurality of symbols on the video reels;

(b) replacing at least one of said video reels adjacent to at least one of said other video reels with an exhibition when a symbol or a combination of symbols occurs on the video reels, said exhibition informing a player of the gaming device that the player has reached a bonus spin of the video reels;

(c) spinning one of the video reels not replaced by the exhibition;

(d) determining if said spinning of said video reels results in an award for a player; and (e) providing said award, if any, to the player.

24. A method of providing a bonus opportunity to a player in a gaming device, said method comprising the steps of:

(a) displaying a plurality of video reels and a plurality of symbols on the video reels;

(b) replacing at least one of said video reels adjacent to at least one of said other video reels with an exhibition when a symbol or a combination of symbols occurs on the video reels, said exhibition informing a player of the gaming device that the player has reached a bonus spin of the video reels;

(c) enabling a player to cause said video reels not replaced by the exhibition to spin a predetermined number of times; and (d) providing the player with any award based on the spin of the video reels not replaced by the exhibition.

25. The method of claim 24, which includes the step of displaying the exhibition for a predetermined period of time following each instant the player causes the video reels to spin during the bonus opportunity.

* * * * *

UNITED STATES PATENT AND TRADEMARK OFFICE
Certificate

Patent No. 6,375,570 B1 Patented: April 23, 2002

On petition requesting issuance of a certificate for correction of inventorship pursuant to 35 U.S.C. 256, it has been found that the above identified patent, through error and without any deceptive intent, improperly sets forth the inventorship.

Accordingly, it is hereby certified that the correct inventorship of this patent is: Richard W. Poole, Reno, NV; and Joseph E. Kaminkow, Reno, NV.

Signed and Sealed this Eighth Day of July 2003.

VALENCIA MARTIN-WALLACE
*Supervisory Patent Examiner*
Art Unit 3713